US007342989B2

(12) United States Patent
Pennington et al.

(10) Patent No.: US 7,342,989 B2
(45) Date of Patent: Mar. 11, 2008

(54) APPARATUSES AND METHODS FOR MECHANICAL SHIELDING AND COOLING

(75) Inventors: Charles W. Pennington, Alpharetta, GA (US); George Carver, Norcross, GA (US)

(73) Assignee: NAC International, Inc., Norcross, GA (US)

( * ) Notice: Subject to any disclaimer, the term of this patent is extended or adjusted under 35 U.S.C. 154(b) by 69 days.

(21) Appl. No.: 11/159,788

(22) Filed: Jun. 23, 2005

(65) Prior Publication Data

US 2006/0291609 A1 Dec. 28, 2006

(51) Int. Cl.
*G21C 19/00* (2006.01)

(52) U.S. Cl. ..... 376/272; 376/293; 376/294; 250/506.1; 250/518.1; 220/4.04

(58) Field of Classification Search ..... 376/272, 376/273, 293, 294; 250/506.1, 518.1; 220/4.04, 220/670
See application file for complete search history.

(56) References Cited

U.S. PATENT DOCUMENTS 3,111,586 A 11/1963 Rogers
3,113,215 A * 12/1963 Allen ..... 250/506.1
3,132,998 A 5/1964 Long et al.
3,296,084 A 1/1967 Fawcett et al.
3,781,189 A 12/1973 Kasberg ..... 176/28
3,888,794 A 6/1975 Kasberg ..... 252/478
3,888,795 A 6/1975 Kasberg ..... 252/478
4,291,536 A * 9/1981 Girard ..... 60/644.1
4,326,130 A * 4/1982 Ahner et al. ..... 250/506.1
4,339,411 A * 7/1982 Knackstedt et al. ..... 376/272
4,368,268 A * 1/1983 Gong ..... 435/161
4,388,268 A * 6/1983 Knackstedt et al. ..... 376/272
4,434,373 A * 2/1984 Christ et al. ..... 250/506.1
4,521,691 A * 6/1985 Christ et al. ..... 250/506.1
4,535,250 A 8/1985 Fields ..... 250/507.1
4,590,383 A * 5/1986 Machado et al. ..... 250/506.1
4,752,437 A 6/1988 Ito et al. ..... 376/272
4,783,309 A 11/1988 Popp et al. ..... 376/272
5,058,655 A * 10/1991 Derp et al. ..... 164/128
5,641,970 A 6/1997 Taniuchi et al. ..... 250/506.1
5,644,608 A * 7/1997 Malik et al. ..... 376/272
5,887,042 A * 3/1999 Akamatsu et al. ..... 376/272

(Continued)

FOREIGN PATENT DOCUMENTS

EP 0757361 A1 2/1997

(Continued)

OTHER PUBLICATIONS

Merriam-Webster's Collegiate Dictionary, 10th Edition, p. 748.*

*Primary Examiner*—Ricardo J. Palabrica
(74) *Attorney, Agent, or Firm*—Thomas, Kayden, Horstemeyer & Risley, LLP

(57) ABSTRACT

A transport or storage cask comprises a cask body, a modular thermal conducting and shielding system and a mechanical attachment. The modular thermal conducting and shielding system includes a modular fin and a modular neutron shield. The mechanical attachment retains the modular thermal conducting and shielding system to the cask body. The modular fin is disposed between the modular neutron shield and the cask body. The modular fin is capable of dissipating thermal energy from the cask body.

21 Claims, 7 Drawing Sheets

U.S. PATENT DOCUMENTS

| | | | | |
|---|---|---|---|---|
| 6,195,404 | B1 * | 2/2001 | Lemogne et al. | 376/272 |
| 6,389,093 | B1 | 5/2002 | Gluschke et al. | 376/272 |
| 6,498,826 | B2 | 12/2002 | Gluschke et al. | 376/260 |
| 6,839,395 | B2 | 1/2005 | Ohsono et al. | 376/272 |
| 2001/0015989 | A1 | 8/2001 | Gluschke et al. | 372/23 |
| 2002/0152841 | A1 | 10/2002 | Ohsono et al. | 75/249 |

FOREIGN PATENT DOCUMENTS

| | | | |
|---|---|---|---|
| EP | 0821367 | A1 | 1/1998 |

* cited by examiner

APPARATUSES AND METHODS FOR MECHANICAL SHIELDING AND COOLING

TECHNICAL FIELD

The present invention is generally related to apparatuses and methods for a cask that stores and/or transports spent nuclear fuel and, more particularly, is related to a cask that includes a modular fin and a modular neutron shield.

BACKGROUND OF THE INVENTION

The removal of spent nuclear fuel from nuclear power plants and the subsequent transport of the spent fuel to an away-from-reactor (AFR) facility for storage or for disposal is a consideration within the nuclear fuel cycle in the United States. As nuclear power plants reach maximum spent fuel pool capacity, the nuclear power plants are off-loading the longer-cooled fuel into storage. Existing storage campaigns could soon deplete the longer-cooled fuel and result in an ever-increasing supply of short cool-time fuel and high heat loads. Development of large, high-heat capacity storage and transport casks could support this future need of the nuclear industry.

Two major issues, among others, drive the desire for a more thermally efficient packaging. First, a more thermally efficient package holds more fuel assemblies, e.g., the package has higher capacity. This feature makes both storage and transport packages very attractive. Reduction of materials, fabrication, operations, project oversight and/or storage area directly reduces the cost per fuel assembly of both fuel storage and transport. Secondly, current spent fuel pool inventories are trending toward short cool-time fuel. As the inventory of cooler fuel is reduced, the per-fuel-assembly thermal load could steadily increase. A high thermal capacity design could address the increasing heat loads for this short cool-time fuel inventory, facilitating dry spent fuel storage.

A high thermal capacity cask might also address the needs of nuclear power plants to ship very hot fuel directly to a repository or AFR storage. This high thermal capacity cask could utilize an approach for a more efficient, more economical cooling configuration.

Thus, a special need exists in the industry to address the evolving conditions of spent fuel storage and transport.

SUMMARY OF THE INVENTION

Disclosed are apparatuses and methods for transporting or storing spent nuclear fuel. In one embodiment, among others, a transport or storage cask comprises a cask body, a modular thermal conducting and shielding system, and a mechanical attachment. The modular thermal conducting and shielding system includes a modular fin and a modular neutron shield. The modular fin is disposed between the modular neutron shield and the cask body. The modular fin is capable of dissipating thermal energy from the cask body. The modular neutron shield is capable of shielding radiation generated within the cask. The mechanical attachment retains the modular thermal conducting and shielding system to the cask body.

In another embodiment, among others, a method of making a transport or storage cask comprises the steps of providing a cask body and attaching a mechanical attachment to the cask body. The method further comprises retaining a modular thermal conducting and shielding system on the cask body via the mechanical attachment. The modular thermal conducting and shielding system includes a modular fin and a modular neutron shield. The method further comprises disposing the modular fin between the modular neutron shield and the cask body. The modular fin is capable of dissipating thermal energy from the cask body. The modular neutron shield is capable of shielding radiation generated within the cask.

In yet another embodiment, among others, a method for operating a transport or storage cask comprises the steps of loading fuel assemblies into a cask body of the cask. The fuel assemblies are capable of generating thermal energy. The method further comprises absorbing thermal energy by the cask body and dissipating thermal energy absorbed by the cask body via a modular fin that is retained on the cask body via a mechanical attachment. The modular fin is disposed on the outer surface of the cask body. The method further comprises shielding radiation generated from the fuel assemblies via a modular neutron shield that is retained on the cask body via the mechanical attachment. The modular neutron shield is disposed on top of the modular fin.

One advantage, among others, of utilizing a modular thermal conducting and shielding system is that the modular fin and the modular neutron shield allow for a wider selection of thermally efficient materials, as well as variations in profiles and sizes of either the cooling fins or the modular neutron shield. Another advantage, among others, is the protection of the thermally sensitive modular neutron shield from the potentially damaging heat generated by the casks. Neutron shield materials used for storage and transport casks have temperature limits below which the neutron shield materials must function to reliably provide shielding performance. Temperatures in excess of these limits are one of the factors that restrict cask capacity or the heat content of the fuel to be stored or transported in casks.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Disclosed are apparatuses and methods for a cask that stores and/or transports spent nuclear fuel. In one embodiment, the cask includes a modular thermal conducting and shielding system that includes a modular fin and a modular neutron shield. The cask further includes a mechanical attachment that retains the modular thermal conducting and shielding system to a cask body. The modular fin is disposed between the modular neutron shield and the cask body. The modular fin is capable of dissipating thermal energy from the cask body. The modular neutron shield is capable of shielding radiation generated within the cask. The embodiments within this disclosure could protect the modular neutron shield from the heat generated from the cask body by conducting the heat around the modular neutron shield and dissipating the heat to the ambient atmosphere.

Exemplary apparatuses are first discussed with reference to the figures. Although the apparatuses are described in detail, the apparatuses are provided for purposes of illustration only and various modifications are feasible. After the exemplary apparatuses have been described, examples of methods of making and operating a cask are provided.

Figure 1:
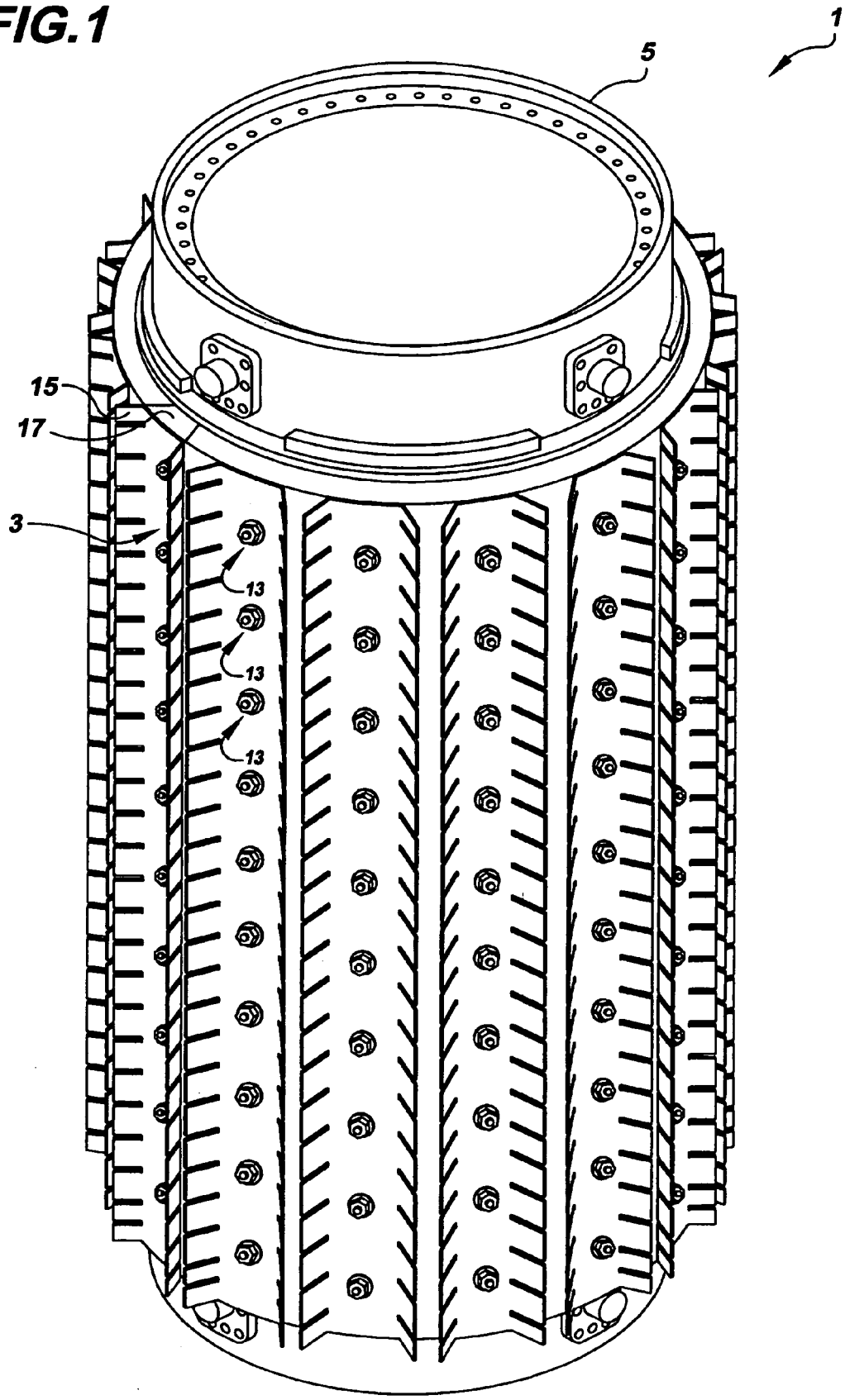
FIG. 1 is a perspective view of an embodiment of a cask that stores or transports nuclear spent fuel.

Referring now in more detail to the figures in which like reference numerals identify corresponding parts, FIG. 1 is a perspective view of an embodiment of a cask that stores and/or transports nuclear spent fuel. The cask 1 includes a right cylindrical cask body 5. It should be understood that there may be other cross-sectional shapes for the cask body 5, e.g., square, rectangular, octagonal, triangular cask bodies, as well as a variety of lengths. The cask 1 further includes a modular thermal conducting and shielding system 3 that is retained to the cask body 5 by way of mechanical attachments 13. The modular thermal conducting and shielding system 3 may extend between the top and bottom of the cask 1. The modular thermal conducting and shielding system 3 includes a modular fin 15 and a modular neutron shield 17, which are described hereafter and illustrated in FIGS. 2-3.

Figure 2:
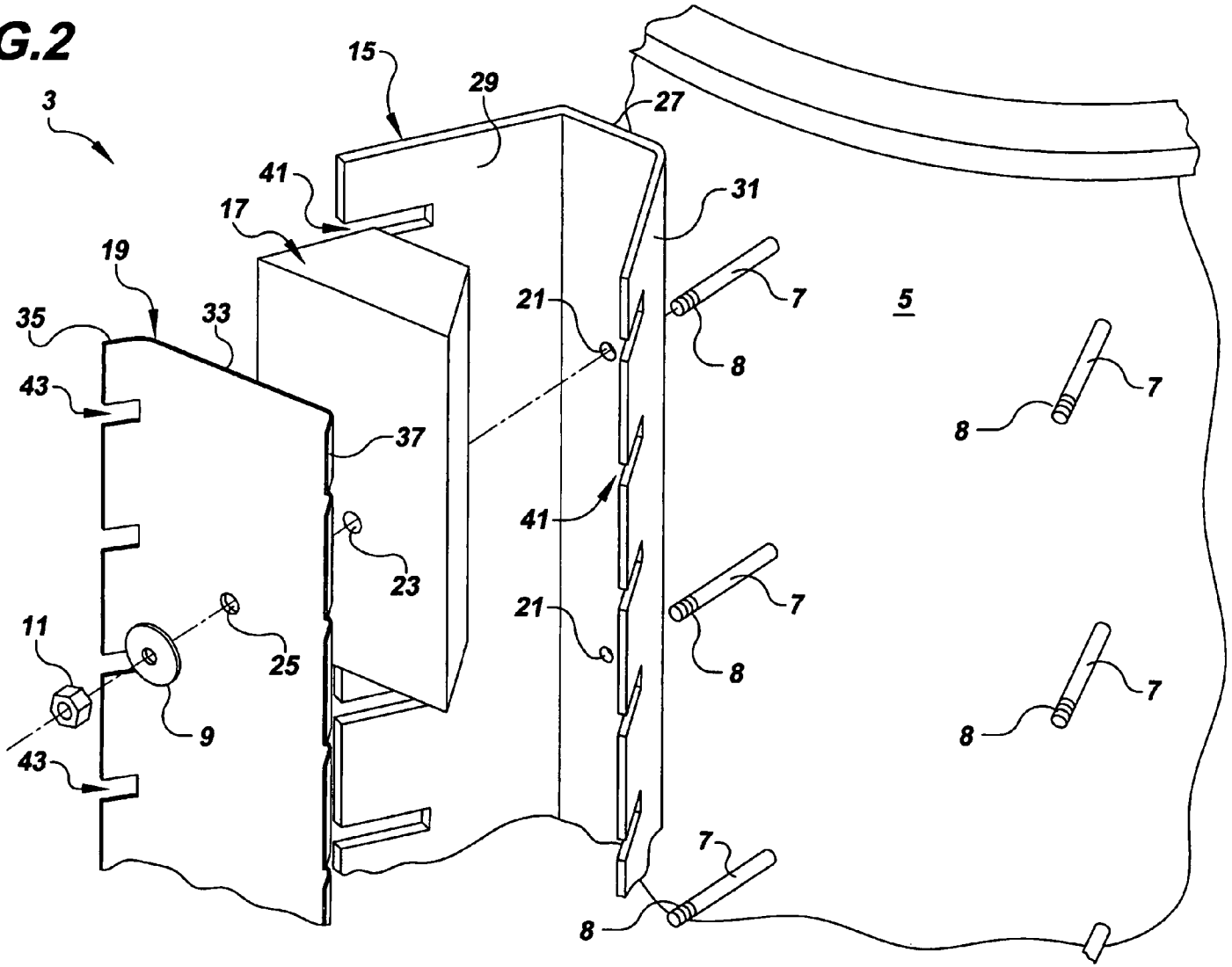
FIG. 2 is a partially cut-away, perspective view of an embodiment of the cask shown in FIG. 1.

FIG. 2 is a partially cut-away, perspective view of an embodiment of the cask 1 shown in FIG. 1. Each mechanical attachment 13 includes a welded or threaded stud 7, washer 9 and nut 11. In the preferred embodiment, the stud 7 is welded onto the outer surface of the cask body 5. However, the stud 7 may also be threaded like a bolt for attachment to the cask body 5.

An outer threaded portion 8 of the stud 7 extends away from the cask body 5 and is capable of engaging with a washer 9 and nut 11 to retain the modular thermal conducting and shielding system 3. The stud 7 should not be substantially thermally conducting because the application of the cask 1 may require that the thermal energy be conducted around the modular neutron shield 17 and not through it. There may be a temperature limitation on the modular neutron shield 17 in order to maintain the modular neutron shield 17 design life.

In this particular embodiment, the modular neutron shield 17 has a shape of a trapezoid and the modular fin 15 has a shape of an elongated letter V. A base 27 of the modular fin 15 is capable of coupling to the cask body 5. Each arm 29, 31 of the modular fin 15 has a distal and a proximal end. The distal end of each arm 29, 31 extends away from the cask body 5, and the proximal end of each arm 29, 31 is integrally connected to the base 27 of the modular fin 15.

Each distal end of the arms 29, 31 has slots 41 that enable air to flow through the slots 41 of the modular fin 15 to facilitate dissipation of thermal energy conducted from the cask body 5. The slots 41 are distributed along the modular fin 15 that extends between the top and bottom of the cask 1. The modular fin 15 is essentially an elongated V-shaped fin. The base 27 of the modular fin 15 further includes holes 21 that are located along the length of the base 27. The welded studs 7 pass through the holes 21 of the modular fin 15 as the modular fin 15 is placed on the cask body 5.

The modular neutron shield 17 is an elongated trapezoid that conforms to the inner section of the modular fin 15. The modular neutron shield 17 extends along the elongated modular fin 15. The modular neutron shield 17 further includes holes 23 that are located along the length of the modular neutron shield 17. The modular neutron shield 17 is placed on the cask body 5 by passing the studs 7 through holes 23 of the modular neutron shield 17.

In this particular embodiment, the modular thermal conducting and shielding system 3 can further include a conductive cover 19 in which the modular neutron shield 17 is disposed between the modular fin 15 and the conductive cover 19. The conductive cover 19 engages and conducts thermal energy from the modular fin 17. The conductive cover 19 includes a base 33, a first arm 35, and a second arm 37. The base 33 is capable of covering the modular neutron shield 17. Each of the first and second arms 35, 37 has a distal end and a proximal end. The distal end of each arm 35, 37 extends away from the cask body 5. The proximal end of each arm 35, 37 is integrally connected to the base 33 of the conductive cover 19. The distal end of each arm 35, 37 has slots 43 that are aligned with the slots 41 of the modular fin 15 to enable air to flow through the slots of the modular fin 15 and the conductive cover 19, which facilitates dissipation of thermal energy conducted from the cask body 5. The conductive cover 19 may extend between the top and bottom of the cask 1 and further includes holes 25 along the length of the conductive cover 19. The welded stud 7 passes through the holes 25 of the conductive cover 19 as the conductive cover is placed on the cask body 5. According to one embodiment, in order to retain the conductive cover 19, modular neutron shield 17, and modular fin 15 of the modular thermal conducting and shielding system 3, the washer 9 is placed through the stud 7 and on top of the conductive cover 19. The nut 11 is screwed onto the outer threaded portion 8 of the stud 7 and is disposed on top of the washer 11.

Figure 3:
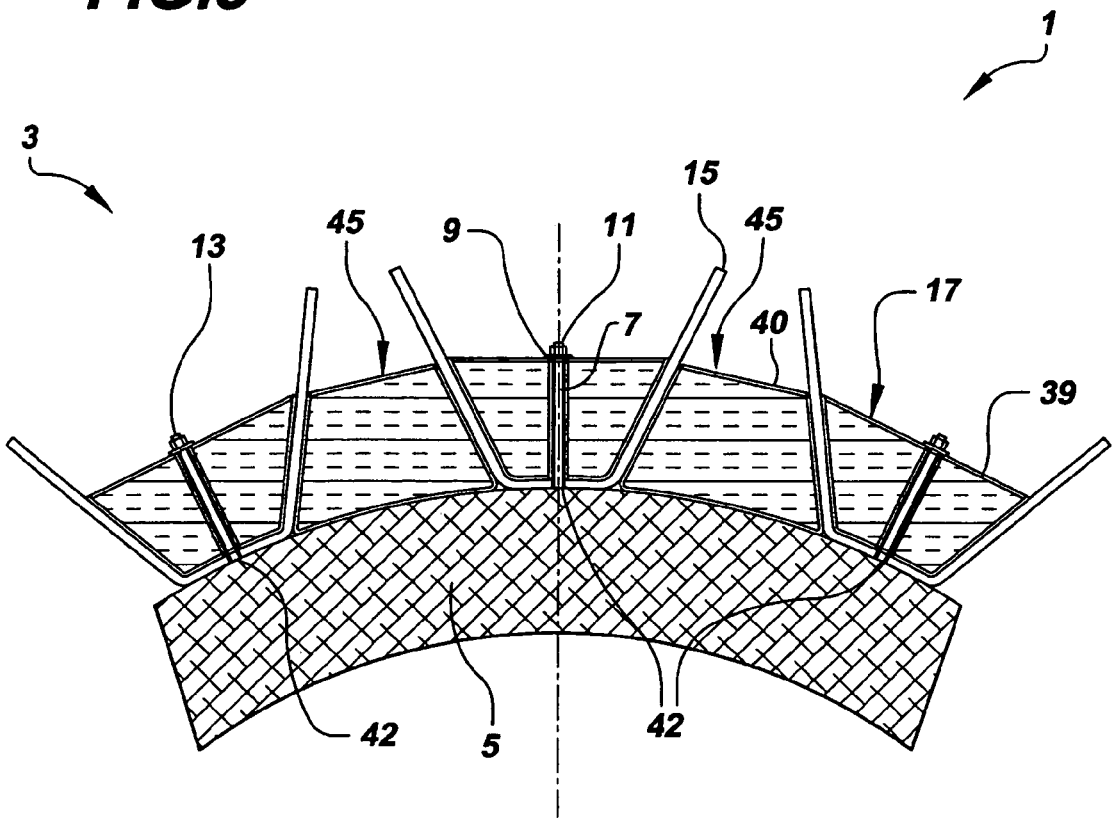
FIG. 3 is a partially cut-away, cross-sectional, top view of an embodiment of a modular thermal conducting and shielding system shown in FIG. 1 that includes a modular fin and a modular neutron shield that are assembled on the cask body.

FIG. 3 is a partially cut-away, cross-sectional, top view of an embodiment of the shield system for the cask 1 shown in FIG. 1 that includes a modular fin and modular neutron shield. Each modular neutron shield 17 is retained to the modular thermal conducting and shielding system 3 by way of the mechanical attachment 13. Each stud 7 of the mechanical attachment 13 is welded at weld 42 on the cask body 5. The modular thermal conducting and shielding system 3 further includes second modular neutron shields 45 that are retained to the cask body 5 by way of the V-shaped fins 15. Each second modular neutron shield 45 is placed between the V-shaped fins 15. The use of alternating trapezoidal neutron shields 45 provides a nested or keystone method of retaining the intermediate neutron shield 45 that is not retained by mechanical attachment 13. This embodiment utilizes a minimum number of mechanical attachments 13, thereby reducing fabrication and assembly costs. The mechanical attachment 13 may include, for example, but is not limited to, aluminum alloys, copper alloys, silver alloys, and/or any higher thermally conductive metal or alloys.

Each of the modular neutron shields 17, 45 may be encapsulated by neutron-shield enclosures 39, 40, that protect the modular neutron shield 17 from exposure to some particular environment. According to one embodiment, it would be appreciated that the enclosures 39, 40 for the modular neutron shields 17, 45 are made of material that is capable of providing the necessary thermal protection in the event of a regulatory hypothetical accident condition. The modular neutron shields 17, 45 would remain intact and capable of performing the intended function. The enclosure 39 provides the necessary stiffness for the modular neutron shield 17 over the length of the cask 5 to insure intimate contact of the modular fin 15 to the cask body 5 when the mechanical attachment 13 is installed. The enclosure 40 provides the necessary stiffness for the second modular neutron shield 45 over the length of the cask 5 to insure intimate contact of the second modular neutron shield 45 to the cask body 5 when the modular fin 15 is installed.

Figure 4:
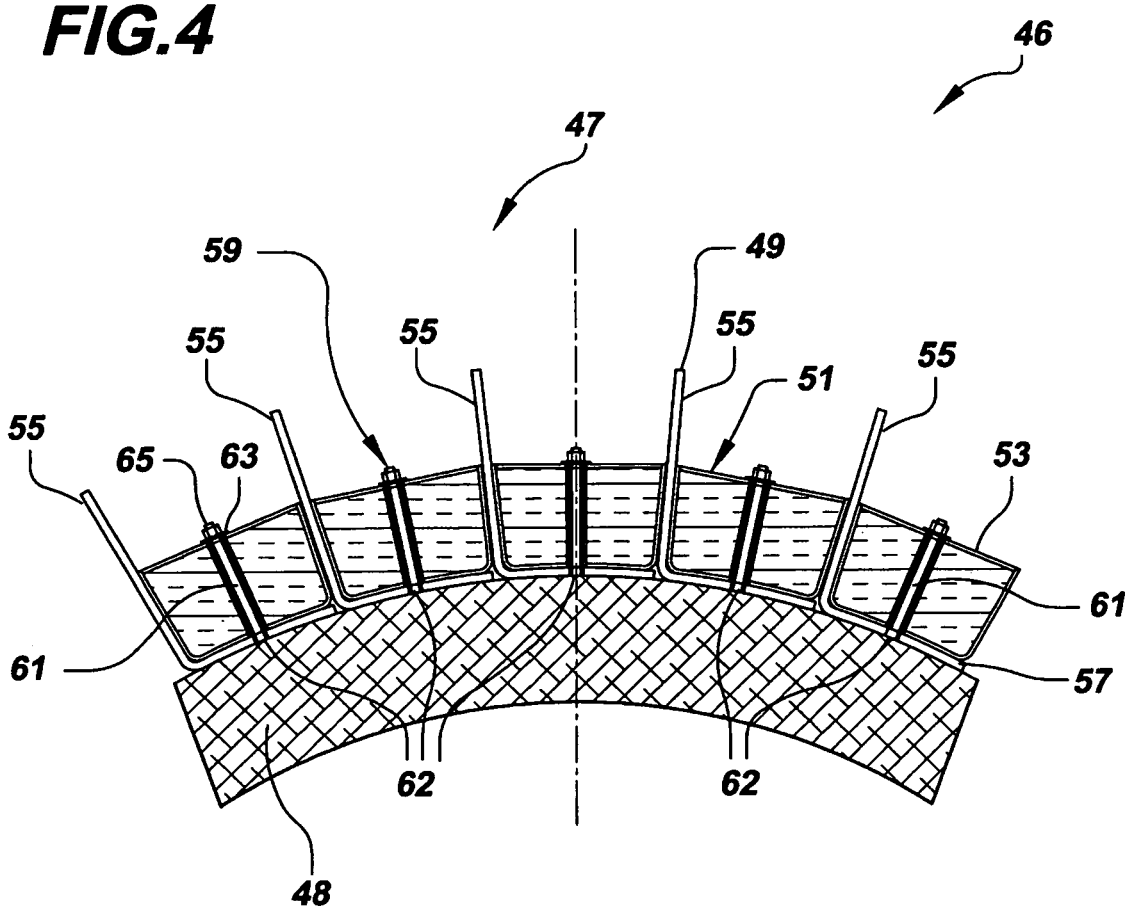
FIG. 4 is a partially cut-away, cross-sectional, top view of an embodiment of another modular thermal conducting and shielding system.

FIG. 4 is a partially cut-away, cross-sectional, top view of another embodiment of the modular thermal conducting and shielding system. The cask 46 includes modular thermal conducting and shielding systems 47 that include modular L-shaped fins 49 and modular square-shaped neutron shields 51. The modular thermal conducting and shielding systems 47 are retained to the cask 46 by way of the mechanical attachments 59. The modular thermal conducting and shielding systems 47 are sequentially aligned adjacent to each other along the outer surface of the cask body 48. In this embodiment, the modular neutron shields 51 are identical to each other, thereby simplifying the fabrication process by reducing the number of different parts to assemble the modular thermal conducting and shielding systems 47. Further, each modular fin 49 and each modular shield 51 are independently retained by one mechanical attachment 59. Each mechanical attachment 59 includes stud 62 connected at weld or bolt recess 62, washer 63 and nut 65. Each modular shield 51 is encapsulated by a square enclosure 53. Each modular fin 49 includes a base 57 that is integrally connected to an arm 55. The distal end of each arm 55 extends away from the cask body 48. The proximal end of each arm 55 is integrally connected to the base 57 of the modular fin 49. The distal end of each arm 55 may have slots (not shown) that enable air to flow through the slots of the modular fin to facilitate the dissipation of the thermal energy conducted from the cask body 48.

Figure 5:
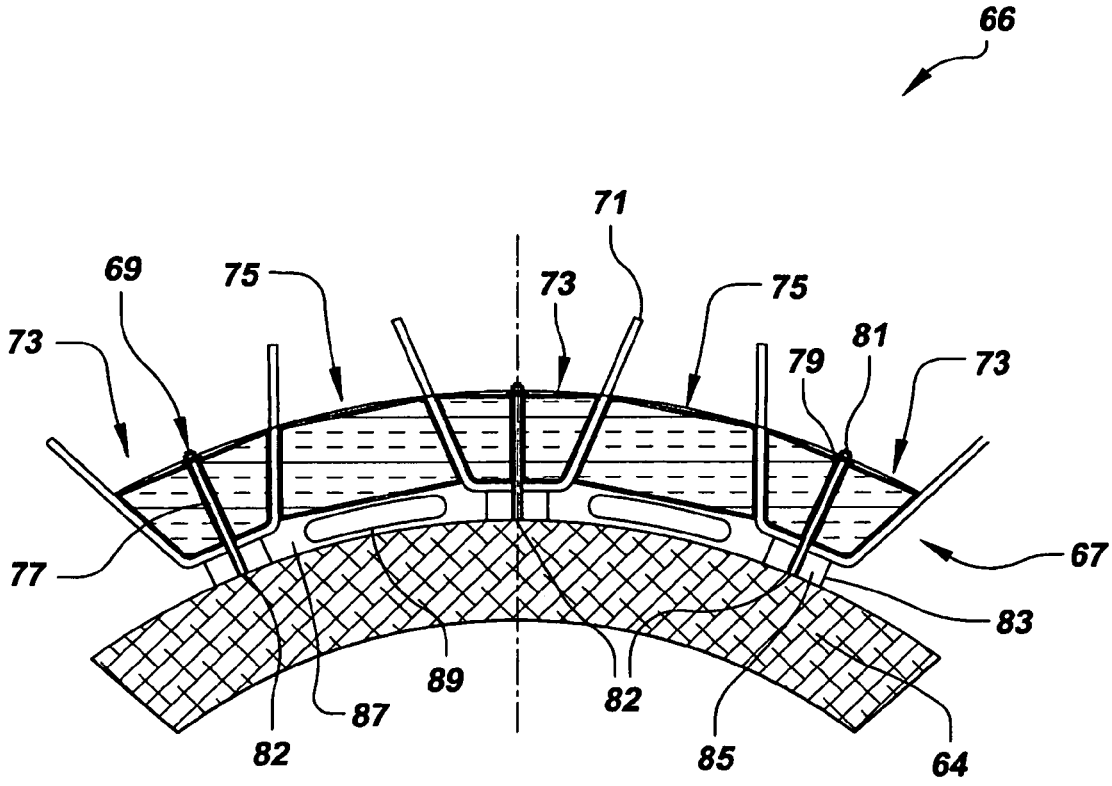
FIG. 5 is a partially cut-away, cross-sectional, top view of an embodiment of yet another modular thermal conducting and shielding system.

FIG. 5 is a partially cut-away, cross-sectional, top view of an embodiment of yet another modular thermal conducting and shielding system. The cask 66 includes modular thermal conducting and shielding systems 67 that are similar to the modular thermal conducting and shielding systems shown in FIG. 3, which includes V-shaped modular fins 71, mechanical attachments 69, and trapezoidal shaped neutron shields 73, 75. Each mechanical attachment 69 includes a stud 77 that is attached at weld or bolt recess 82, washer 79, and nut 81.

In addition, in this embodiment, the cask 66 further includes modular thermal extensions 83 that may extend between the top and bottom of the cask 66. Each thermal extension 83 includes an extended member 85 and an annular air gap 87. The thermal extensions 83 can conduct thermal energy from the cask body 64. Each extended member 85 includes holes (not shown) in which the stud 77 passes through, as the thermal extension 83 is disposed on the cask body 64. The extended members 85 are disposed between the V-shaped modular fin 71 and the cask body 64. The annular air gap 87 of the thermal extension 83 is disposed between the cask body 64 and the modular thermal conducting and shielding system 67 and also between the extended members 85. The annular air gap 87 enables convective heat flow through an annular region 89 of the annular air gap 87 that further facilitates dissipation of thermal energy from the cask body 64. The annular air gap 87 addresses the need for high heat load applications and enables air convection to occur. The air convection of the annular air gap 87, in conjunction with the heat dissipation of the modular fins 71, enables the cask to remove the high heat loads stored and transported using the cask 66.

It should be appreciated from the different modular thermal conducting and shielding systems in FIGS. 3, 4, and 5 that the number and geometry of the thermal extensions, modular neutron shields and modular fins are determined based on each separate analysis and application of a cask. In this regard, the geometry of the modular fins and the modular neutron shields may include, but is not limited to, the shapes of the following: trapezoidal, rectangular, circular, square, etc. The geometry of the arms and bases of the modular fins may include, but is not limited to, the shapes of the following: rectangular plates, round tubes or posts, serrated or perforated plates, re-entrant forms, etc.

Figure 6:
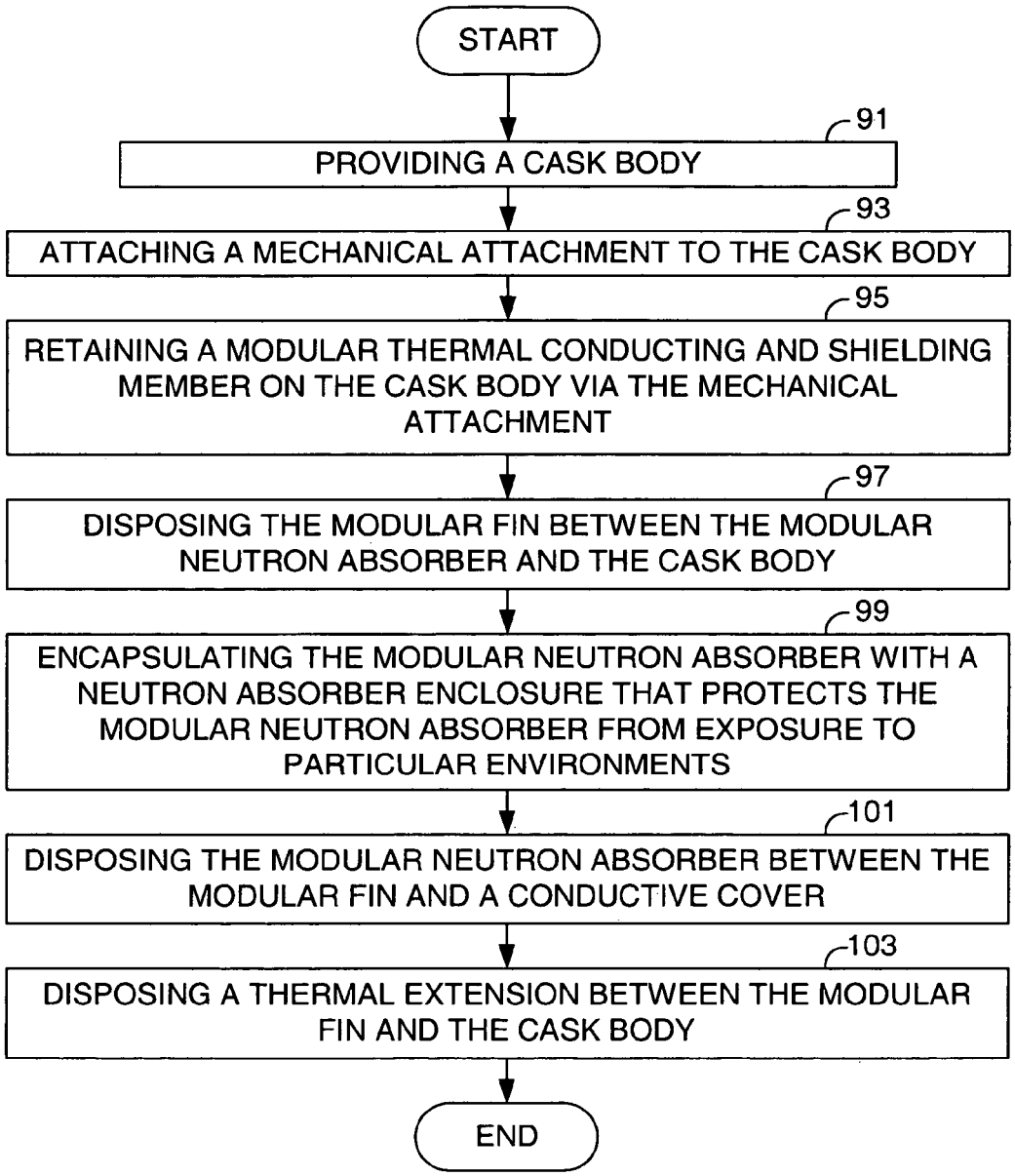
FIG. 6 is a flow diagram that illustrates an embodiment of making a cask using modular fins and modular neutron shield.

FIG. 6 is a flow diagram that illustrates an embodiment of a method 90 for making a cask 1 using modular fins 15 and modular neutron shields 17. Referring now to block 91, the method 90 for making a transport or storage cask 1 includes providing a cask body 5. In block 93, a mechanical attachment 13 is attached to the cask body 5. The mechanical attachment 13 can include a welded stud or a bolt, or any other similar mechanical attachments. In block 95, the method 90 further includes retaining a modular thermal conducting and shielding system 3 on the cask body 5 via the mechanical attachment 13. The modular thermal conducting and shielding system 3 includes a modular fin 15 and a modular neutron shield 17. In block 97, the modular fin 15 is disposed between the modular neutron shield 17 and the cask body 5.

In block 99, the modular neutron shield 17 is encapsulated with a neutron-shield enclosure 39 that protects the modular neutron shield 17 from exposure to any form of liquid or particular environments. In block 101, the modular neutron shield 17 is disposed between the modular fin 15 and a conductive cover 19. In block 103, the method 90 includes disposing a thermal extension 83 between the modular fin 15 and the cask body 5. The thermal extension 83 includes an annular air gap 87 having a convective air flow region 89. The thermal extension 83 is capable of conducting thermal energy from the cask body 5 enabling the dissipation of thermal energy from the cask body 5.

Figure 7:
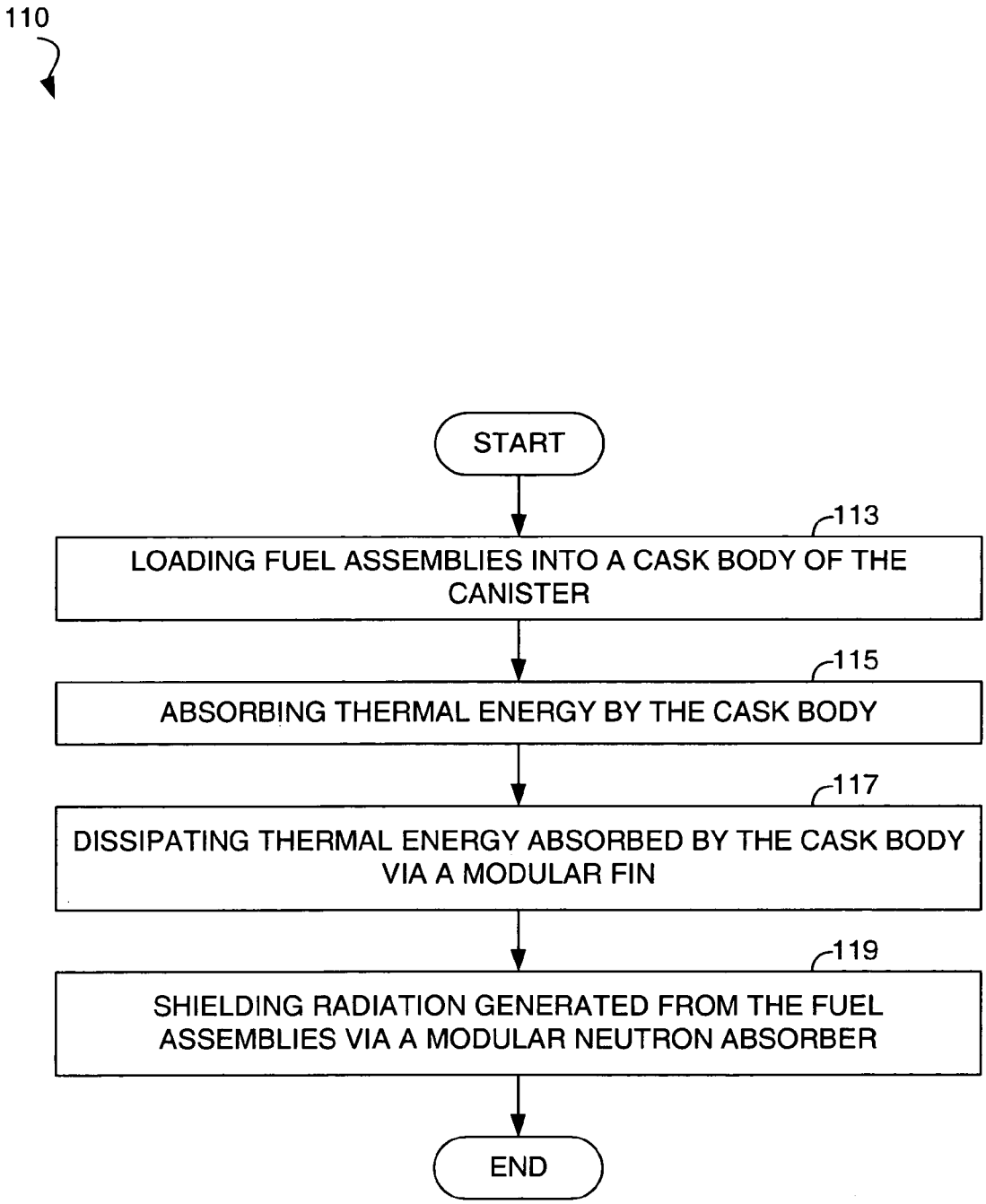
FIG. 7 is a flow diagram that illustrates an embodiment of operating a cask using modular fins and modular neutron shield.

FIG. 7 is a flow diagram that illustrates an embodiment of a method 110 for operating a cask 1 using modular fins 15 and modular neutron shields 17. Referring now to block 113, the method 110 for operating a transport or storage cask 1 includes loading fuel assemblies (not shown) into a cask body 5 of the cask 1. The fuel assemblies generate thermal energy, which is absorbed by the cask body 5 shown in block 115. In block 117, the method 110 further includes dissipating thermal energy absorbed by the cask body 5 via a modular fin 15, which is retained on the cask body 5 via a mechanical attachment 13. The modular fin 15 is disposed on the outer surface of the cask body 5. In block 119, the method 110 further includes shielding radiation generated from the fuel cell via a modular neutron shield 17, which is also retained on the cask body 5 via the mechanical attachment 13. The modular neutron shield 17 is disposed on top of modular fin 15.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A transport or storage cask, comprising:

a cask body;

a modular thermal conducting and shielding system that includes a modular fin and a modular neutron shield, the modular fin being disposed between the modular neutron shield and the cask body, the modular fin being capable of dissipating thermal energy from the cask body, the modular fin including a base and an arm, the base being capable of coupling to the cask body, the arm of the modular fin having a distal end and a proximal end, the proximal end of the arm being integrally connected to the base of the modular fin and the distal end of the arm extending away from the cask body, the modular neutron shield being disposed on top of the base of the modular fin, the distal end of the arm having slots that enables air flow to facilitate dissipation of thermal energy conducted from the cask body;

a mechanical attachment that retains the modular thermal conducting and shielding system to the cask body; and a conductive cover in which the modular neutron shield is disposed between the modular fin and the conductive cover, the modular neutron shield being capable of shielding radiation generated within the cask body, wherein the modular thermal conducting and shielding system further comprising the conductive cover that is disposed on top of the modular neutron shield, the conductive cover including a base, a first arm and a second arm, the base being capable of covering the modular neutron shield, each of the first and second arms having a distal end and a proximal end, the proximal end of the arm being integrally connected to the base of the conductive cover and the distal end of the arm extending away from the cask body, the distal end of the arm having slots that are aligned with the slots of the modular fin to enable air to flow through the slots of the modular fin and the conductive arm, each of the first and second arms being capable of engaging the arm of the modular fin, the conductive cover being capable of facilitating dissipation of thermal energy conducted from the cask body.

2. The cask of claim 1, further comprising a neutron-shield enclosure that encapsulates the modular neutron shield and protects the modular neutron shield from exposure to particular environments.

3. The cask of claim 1, wherein the modular neutron shield has a shape of a trapezoid and the modular fin has a shape of an elongated letter V, the modular neutron shield being retained to the cask body by way of the mechanical attachment.

4. The cask of claim 3, wherein the modular thermal conducting and shielding system further comprising a second modular neutron shield having a shape of a trapezoid, the second modular neutron shield being retained to the cask body by way of the elongated V-shaped fin.

5. The cask of claim 1, wherein the mechanical attachment includes stud, washer, and nut.

6. A transport or storage cask, comprising:

a cask body;

a modular thermal conducting and shielding system that includes a plurality of modular fins and a plural of modular neutron shields, each modular fin being disposed between the respective modular neutron shield and the cask body, each modular fin being capable of dissipating thermal energy from the cask body, each modular fin including a base and an arm, the base being capable of coupling to the cask body, the arm of the modular fin having a distal end and a proximal end, the proximal end of the arm being integrally connected to the base of the modular fin and the distal end of the arm extending away from the cask body, each modular fin being placed adjacent to another modular fin; and mechanical attachments that retain the modular thermal conducting and shielding system to the cask body.

7. The cask of claim 6, further comprising a plurality of neutron-shield enclosures each encapsulating the respective neutron shield and protects the respective neutron shield from exposure to particular environments.

8. The cask of claim 7, wherein each modular neutron shield has a shape of a trapezoid and each modular fin has a shape of an elongated letter V, each modular neutron shield being retained to the cask body by way of the mechanical attachment.

9. The cask of claim 7, wherein the modular thermal conducting and shielding system further comprising a plurality of second modular neutron shields having a shape of a trapezoid, each second modular neutron shield being retained to the cask body by way of the elongated V-shaped fin.

10. The cask of claim 6, wherein the mechanical attachment includes stud, washer, and nut.

11. The cask of claim 6, further comprising a plurality of conductive covers in which each modular neutron shield is disposed between the respective modular fin and the respective conductive cover, each modular neutron shield being capable of shielding radiation generated within the cask body.

12. The cask of claim 11, wherein the distal end of the arm having slots that enables air flow to facilitate dissipation of thermal energy conducted from the cask body.

13. The cask of claim 12, wherein the modular thermal conducting and shielding system further comprising the conductive cover that is disposed on top of the modular neutron shield, the conductive cover including a base, a first arm and a second arm, the base being capable of covering the modular neutron shield, each of the first and second arms having a distal end and a proximal end, the proximal end of the arm being integrally connected to the base of the conductive cover and the distal end of the arm extending away from the cask body, the distal end of the arm having slots that are aligned with the slots of the modular fin to enable air to flow through the slots of the modular fin and the conductive arm, each of the first and second arms being capable of engaging the arm of the modular fin, the conductive cover being capable of facilitating dissipation of thermal energy conducted from the cask body.

14. A transport or storage cask, comprising:

a cask body;

a thermal conducting and shielding system that includes a plurality of fins and a plurality of neutron shields, each fin being disposed between the respective neutron shield and the cask body, each fin being capable of dissipating thermal energy from the cask body, each fin including a base, a first arm and a second arm, each of the first and second arms having a distal end and a proximal end, the proximal end of the arm being integrally connected to the base of the fin and the distal end of the arm extending away from the cask body, the neutron shield being disposed on top of the base of the fin, each fin being separate and independent of another fin; and a mechanical attachment that retains the thermal conducting and shielding system to the cask body.

15. The cask of claim 14, further comprising a plurality of neutron-shield enclosures each encapsulating the respective neutron shield and protecting the respective neutron shield from exposure to particular environments.

16. The cask of claim 14, further comprising a plurality of conductive covers in which the respective neutron shield is disposed between the respective fin and the respective conductive cover, each neutron shield being capable of shielding radiation generated within the cask body.

17. The cask of claim 16, wherein the distal end of the first and second arms having slots that enables air flow to facilitate dissipation of thermal energy conducted from the cask body.

18. The cask of claim 17, wherein the thermal conducting and shielding system further comprising the conductive cover that is disposed on top of the neutron shield, the conductive cover including a base, a first arm and a second arm, the base being capable of covering the neutron shield, each of the first and second arms of the conductive cover having a distal end and a proximal end, the proximal end of the arm being integrally connected to the base of the conductive cover and the distal end of the arm of the conductive cover extending away from the cask body, the distal end of the arm of the conductive cover having slots that are aligned with the slots of the fin to enable air to flow through the slots of the fin and the conductive arm, each of the first and second arms of the conductive cover being capable of engaging the arm of the fin, the conductive cover being capable of facilitating dissipation of thermal energy conducted from the cask body.

19. The cask of claim 14, wherein each neutron shield has a shape of a trapezoid and the fin has a shape of an elongated letter V, each neutron shield being retained to the cask body by way of the mechanical attachment.

20. The cask of claim 19, wherein the thermal conducting and shielding system further comprising a plurality of second neutron shields having a shape of a trapezoid, each second neutron shield being retained to the cask body by way of the elongated V-shaped fin.

21. The cask of claim 14, wherein the mechanical attachment includes stud, washer, and nut.

* * * * *